United States Patent [19]

Zeller et al.

[11] 4,365,903

[45] Dec. 28, 1982

[54] LOCKABLE KEY WITH LUMINESCENT DISPLAY FOR OFFICE TYPEWRITERS AND TELEPRINTERS

[75] Inventors: Karl S. Zeller; Heinz Thormann, both of Munich, Fed. Rep. of Germany

[73] Assignee: Siemens Aktiengesellschaft, Berlin & Munich, Fed. Rep. of Germany

[21] Appl. No.: 179,547

[22] Filed: Aug. 19, 1980

[30] Foreign Application Priority Data

Aug. 22, 1979 [DE] Fed. Rep. of Germany ..... 2933983

[51] Int. Cl.[3] ..... B41J 5/12; B41J 29/18

[52] U.S. Cl. ..... 400/490; 400/711; 200/314

[58] Field of Search ..... 400/490, 711, 477, 479, 400/493, 479.1, 678, 479.2, 666, 276.2; 235/145 R, 146; 340/365 VL; 200/313, 314

[56] References Cited

U.S. PATENT DOCUMENTS

| | | | |
|---|---|---|---|
| 3,866,006 | 2/1975 | Westram | 200/153 |
| 4,088,855 | 5/1978 | Emery | 200/314 |
| 4,096,368 | 6/1978 | Grebner | 200/314 |

FOREIGN PATENT DOCUMENTS

| | | |
|---|---|---|
| 2433156 | of 0000 | Fed. Rep. of Germany . |
| 2438108 | of 0000 | Fed. Rep. of Germany . |
| 7122932 | of 0000 | Fed. Rep. of Germany . |
| 7211412 | of 0000 | Fed. Rep. of Germany . |
| 538185 | of 0000 | Switzerland . |

OTHER PUBLICATIONS

Western Electric Technical Digest #46 Apr. 1977, "Pushbutton Assembly", J. E. Distler et al. (p. 17).

*Primary Examiner*—Clifford D. Crowder
*Assistant Examiner*—David J. Isabella
*Attorney, Agent, or Firm*—Hill, Van Santen, Steadman, Chiara & Simpson

[57] ABSTRACT

A lockable key for use on electronic keyboards in office typewriters and teleprinters has a receptacle at an upper portion thereof for receiving a light emitting diode which is mounted in a small circuit board which can be snapped into the upper portion of the key and which is supplied current via flexible interlaced wires. A lower portion of the key has a guide element which cooperates with a guide pin carried on a side of the key base for retaining the upper portion of the key in a depressed state after a first actuation thereof, and for allowing return of the upper portion of the key to the original position after a successive actuation thereof.

4 Claims, 1 Drawing Figure

LOCKABLE KEY WITH LUMINESCENT DISPLAY FOR OFFICE TYPEWRITERS AND TELEPRINTERS

BACKGROUND OF THE INVENTION

1. Field of the Invention

The present invention relates to push-button keys with luminescent displays for electronic keyboards in office typewriters and teleprinters.

2. Description of the Prior Art

For the display of specific operating states of devices actuated by means of an electronic keyboard, such as office typewriters and teleprinters, it is known to employ elements which generate a luminescent display and which are disposed separately outside of the keyboard push-button array. Such arrangements involve relatively elaborate structure and associated electronics, and are further susceptible to disturbance and wear because the current is supplied to such displays via touch contacts.

SUMMARY OF THE INVENTION

It is an object of the present invention to provide a push-button key for use on a keyboard array in an office typewriter or teleprinter which has a luminescent display for signaling specific operating states. It is a further object of the present invention to provide such a key with a luminescent display which corresponds to the dimensions of other keys utilized within the keyboard array. Another object of the present invention is to provide such a key in which the luminescent display is clearly visible and has a very small power requirement. Finally, it is an object of the present invention to provide such a key which may be utilized with or without a mechanical locking device to retain the key in a depressed or actuated position, followed by release of the key upon a successive actuation.

The above objects are inventively achieved in a push-button key having a lateral receptacle at an upper portion thereof for receiving a light emitting diode and a small circuit board on which the diode is mounted in plug-in fashion for receiving current supplied by flexible cables or wires for which recesses are provided in the base of the key. The wires run through the recesses and the circuit board in the form of an interlace or crossed-over loop.

A luminescent display key of the above type requires only a very small current to operate the light emitting diode and because the current is supplied via two flexible wires, the susceptibility to disturbance which occurs when touch contacts are utilized in conventional devices is substantially reduced.

The upper portion of the key is generally hollow so that the circuit board containing the light emitting diode can be inserted therein and may, for example, by snapped into the upper portion of the key so as to facilitate easy assembly and mass production.

In accordance with a further development of the invention, the receptacle in the upper portion of the key which receives the light emitting diode is disposed in such a manner as to lie within the field of view of an operator utilizing the keyboard. This results in a luminescently displayed key which is clearly visible even on a light background. This feature has the further advantage that the surface of the upper portion of the key may be provided with an inscription and that the dome of the light emitting diode does not prove disturbing when the key is actuated.

The key and luminescent display may be utilized either with or without a mechanical locking for the switching position of the key. If no mechanical locking is utilized in combination with the key, the luminescent display is switched on and off whenever the key is depressed by means of a follow-up electronics unit of the type known in the art. In the latter case, the key is provided with a mechanical locking device by which the key is maintained in a first depressed position immediately following its actuation, and is unlocked by a successive re-actuation of the key.

An embodiment of the present invention utilizing a mechanical locking device has a guide component integrally molded on or secured to a sliding member of the key and a latching lever having a generally vertical central portion and opposed legs extending perpendicularly from the central portion at opposite ends thereof. One leg of the latching lever is rotatably mounted in a side of a housing for the key and the other leg of the lever serves as a guide pin which slides within the guide component and cooperates therewith to lock the key. The guide element has a guide slope which terminates in a groove and a locking recess which engages the guide pin when the key is actuated by depression thereof. The guide element is further provided with a guide edge which extends from the locking recess in an opposite direction and by which the guide pin is returned to the starting position upon a successive re-actuation of the key.

DESCRIPTION OF THE PREFERRED EMBODIMENTS

Figure 1:
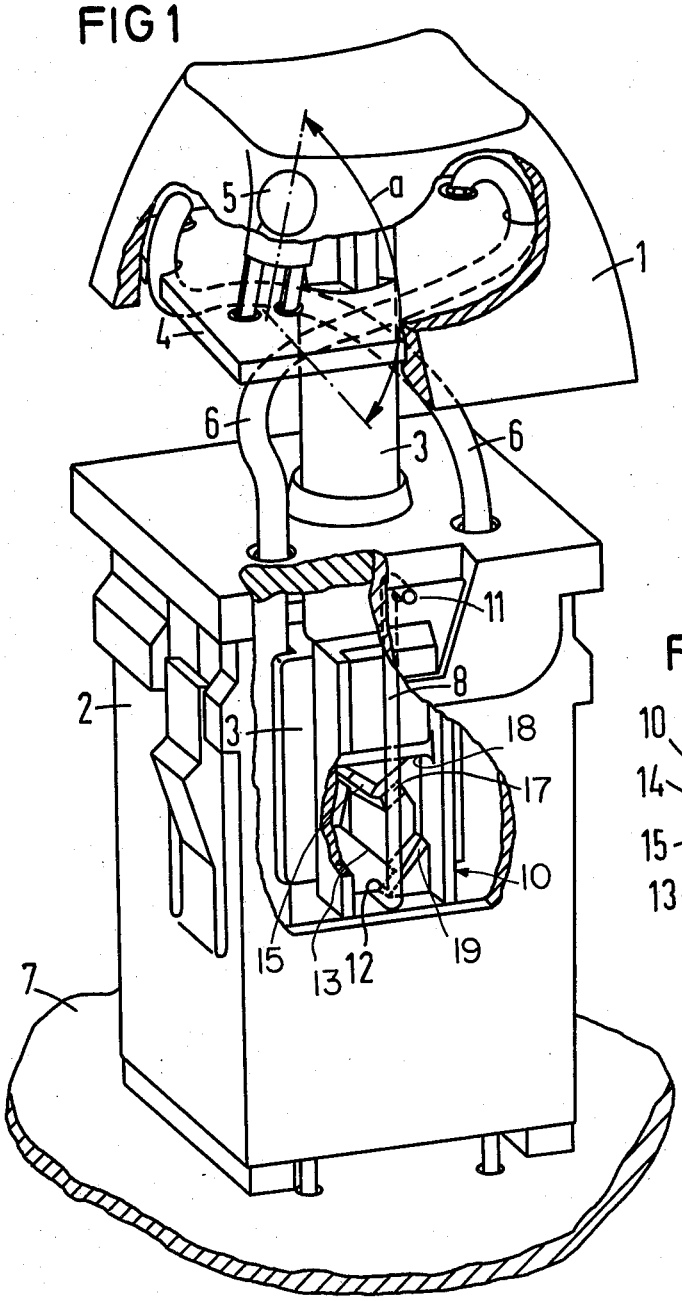
FIG. 1 is a perspective view, partly broken away, of a lockable key with a luminescent display constructed in accordance with the principles of the present invention.

As shown in FIG. 1, a key with a luminescent display has a key button 1 having a slide 3 attached thereto and extending generally downwardly therefrom into a key base 2. The slide 3 is slidably received in the base 2 and is biased therein by a spring or any other suitable structure known to those skilled in the art. The key button 1 is generally hollow and receives a circuit board 4 by snap or press fit which has a light emitting diode 5 mounted thereon so as to be disposed in the interior of the key button 1. The key button 1 is comprised at least on an upper portion thereof of a translucent or transparent material so that light from the light emitting diode 5 may be seen through the key button 1 by an operator.

Current is supplied to the light emitting diode 5 by a pair of interlaced or crossed-over flexible wires 6 which extend through recesses cut in opposite sides of the circuit board 4 and make an electrical connection with the circuit board 4 within the hollow of the key button 1. Because of the crossed-over loop formation of the flexible current supply wires 6, a sufficiently high actuation coefficient is achieved without danger of breakage of the wires 6.

The key base 2 is provided with a lateral guide and holding structure for the slide 3 of a type known in the art and by means of which the key button and slide assembly is inserted and held in a base plate. The supply wires 6 extend through the base 2 and are connected to a keyboard circuit board 7 from which power is received. In order to facilitate the insertion of the current supply wires 6 into the base 2 when the key button 1 is placed in position, the ends of the current supply wires 6 are provided with a soldering pin which may, for example, be applied by crimping, and which is utilized to form the mechanical and electrical solder connection to the keyboard circuit board 7. The electrical contact which enables or connects a power source for the diode 5 is established when the key button 1 is actuated by depression thereof and the triggering of the function assigned to the key is made by any suitable means in a known manner via the circuit board 7.

If the key is utilized as a so-called simple key wherein the switching on and off of the luminescent display is achieved by conventional post-connected electronics whenever the key is depressed, it is possible to dispense with a mechanical locking device for the key. In such a case, the contacting and switching of the luminescent display is achieved by connection of the flexible wires 6 to a power supply in a known manner by a first depression of the key and disconnection of the power supply by the next successive depression of the key.

If the key is used in devices in which either no post-connected electronics unit is provided or in which a mechanical locking device is required in addition to the above-described post-connected electronics unit, the key is provided with a guide element 10 which is molded onto the slide 3 and a latching lever 8. The latching lever 8 has a generally vertical straight central portion and terminates in opposed legs 11 and 12 which extend generally perpendicularly to the central portion. The leg 11 is rotatably received in a side of the base 2 and the leg 12 serves as a guide pin and extends into the guide element 10. Further structural details of the guide element 10 and the functioning thereof will be described on the basis of FIG. 2.

Figure 2:
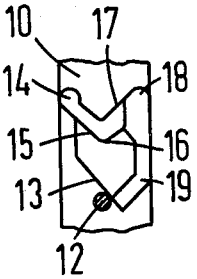
FIG. 2 is a side view of a locking mechanism for the key shown in FIG. 1.

When the key button 1 is in an unactuated or rest state the leg or guide pin 12 of the latching lever 8 rests against a guide slope 13 of the guide element 10 as shown in FIG. 2. Upon depression of the key button 1, and corresponding downward movement of the slide 3 and the guide element 10, the pin 12 slides along the guide slope 13 being simultaneously rotated about the pivot point of the leg 11 until the pin 12 reaches a groove 14 which forms a stop and into which the guide pin 12 falls. This position of the guide pin 12 serves to limit the depression depth of the key. If the key is now released, the guide pin 12 of the latching lever 8 follows a guide edge 15 until engaging a locking recess 16 which retains the key button 1 and the slide 3 in an actuated or depressed state against the biasing means contained in the base 2, so that the key is mechanically locked in this position. Furthermore, in this position the contacts to the post-connected electronics unit for supplying power to the light emitting diode 5 are established and the luminescent display is switched on.

In order to unlock the key it is necessary to again depress the key button 1 upon which the guide pin 12 of the latching lever 8 moves out of the locking recess 16 in an opposite direction along a further guide edge 17 until reaching a guide recess 18. The slide 3 is thus no longer locked in a depressed state and when the pressure on the key button 1 is relaxed the guide pin 12 slides back along the guide edge 19 into the original commencing position. The key button 1 and slide 3 now again occupy the original unactuated starting position and the luminescent display is no longer illuminated as a result of the disconnection of power thereto.

Because the light emitting diode 5 which is utilized for the luminescent display is disposed exclusively within the plug-in key button, any conventional key may be designed so as to accommodate the inventive concept disclosed herein. This facilitates a particularly economical production of such keys and installation thereof in a manner identical to conventional keys so that substantial retooling is not necessary.

In addition, the light emitting diode 5 may be disposed within the hollow portion of the key button 1 at an angle a with respect to the circuit board 4 so that the resulting display is within the field of view of a keyboard operator and is thus easily visible, even on a light background.

Although modifications and changes may be suggested by those skilled in the art it is the intention of the inventors to embody within the patent warranted hereon all changes and modifications as reasonably and properly come within the scope of their contribution to the art.

We claim as our invention:

1. A key with luminescent display for use in keyboard arrays comprising:

a depressible hollow key button at least partially comprised of light-transmissive material and having a slide extending downwardly therefrom;

a key base slidably receiving and supporting said slide and having a bias means normally urging said key button to a non-actuated position;

a circuit board having a light emitting diode mounted thereon which is received in said hollow key button, said circuit board having a pair of recesses respectively disposed at sides thereof;

a pair of flexible wires extending through said key base and through said recesses in said circuit board into said hollow key button and electrically connected to said circuit board inside said key button for supplying power to said light emitting diode, said flexible wires forming a crossed-over loop between said circuit board and said key base; and a means for temporarily connecting said flexible wires to a source of power upon depression of said key button.

2. The key of claim 1 wherein said circuit board is snapped into said hollow key button.

3. The key of claim 1 wherein said light emitting diode is disposed at an angle on said circuit board which is within a field of view of an operator utilizing said keyboard.

4. The key of claim 1 further comprising a mechanical locking means consisting of:

a guide element mounted on a side of said slide and co-movable therewith;

a latching lever having a central straight portion and having an upper leg pivotally mounted in a side of said key base and having a lower guide pin leg engaging said guide element;

said guide element having a first guide slope against which said guide pin rides upon depression of said key button, said first guide slope terminating in a groove and a locking recess for receiving and holding said guide pin at a furthest depression of said key button, and a second guide slope extending from said locking recess in a direction opposite to said first guide slope against which said guide pin leg rides upon a successive depression of said key button while said slide and guide element are moved in an opposite direction by said biasing means for permitting said key button to return to said non-actuated position.

* * * * *